US005816156A

United States Patent [19]

Minkle

[11] Patent Number: 5,816,156

[45] Date of Patent: Oct. 6, 1998

[54] SUCTION FOOT REAPPORTIONING SYSTEM AND PRINTING PRESS

[76] Inventor: Richard Minkle, 407 W. Chestnut Ave., Monrovia, Calif. 91016

[21] Appl. No.: 946,294

[22] Filed: Oct. 7, 1997

[51] Int. Cl.[6] ..... B41F 13/24

[52] U.S. Cl. ..... 101/232; 101/238; 271/103; 271/107

[58] Field of Search ..... 101/230, 231, 101/232, 238, 142; 271/103, 107

[56] References Cited

U.S. PATENT DOCUMENTS 2,341,521 2/1944 Baker ..... 271/103
3,956,985 5/1976 Ishii ..... 101/142
4,118,024 10/1978 Gerhardt ..... 101/230
4,580,773 4/1986 Minkle ..... 271/103

*Primary Examiner*—Eugene H. Eickholt
*Attorney, Agent, or Firm*—Ashen & Lippman

[57] ABSTRACT

A hollow cylinder is fitted with a piston, whose hollow rod or shank protrudes downward from the cylinder to apply lifting suction to print media. The upper end of the cylinder communicates with a suction system. In the cylinder side walls, main passageways and reapportioning passageways apply suction to the underside of the piston when the piston is less than fully extended, drawing the piston down to extend the shank. When the shank is fully extended the piston blocks the reapportioning passageways—reallocating more of the available suction to other feet, in the same system, that remain unextended.

5 Claims, 5 Drawing Sheets

SUCTION FOOT REAPPORTIONING SYSTEM AND PRINTING PRESS

FIELD OF THE INVENTION

This invention relates generally to a suction foot for separating and forwarding sheets of printing medium, and more specifically to a suction foot which partly reapportions suction force among several feet, and to a suction foot system, and to a printing press—each with several such feet.

BACKGROUND OF THE INVENTION

In U. S. Pat. No. 4,580,773 I disclose a sheet-seeking suction foot. This suction foot, which provides combined printing-medium separation and forwarding, along with print-medium leading-edge suspension, has established a good reputation within the printing press industry.

On an individual basis this suction foot performs superbly. When, however, several such feet are used in combination together—each one receiving suction from the same suction system—occasionally it has been noted that not all the feet extend fully, or not all grip the printing medium firmly. Such possible degradation in performance may arise partly from interaction between the suction feet and the suction system.

A standard suction system includes a suction pump, a tube traversing the printing press for transmitting the suction generated by the pump, and a number of hoses connected to the tube for transmitting suction to individual feet. Often, due to airflow resistance within the tube, the suction weakens along the length of the tube.

This uneven distribution of suction along the tube can result, for a foot that is far from the pump, in inadequate extension suction, i.e. the suction required to fully extend the suction foot. It can also result in inadequate gripping suction, i.e. the suction required to secure and lift sheets of medium.

SUMMARY OF THE DISCLOSURE

The present invention has several facets that can be used independently. They are preferably used together to optimize their benefits.

In preferred embodiments of a first of its independent aspects or facets the invention is a suction foot for separating and forwarding sheets of printing medium. The suction foot is for use in a printing press that has a plurality of such feet and a suction system. The foot includes a cylinder having external side walls and a closed upper end to define a cavity. The cylinder also has a lower end with a constricted aperture.

A piston is closely fitted within the cavity. Extending downward from the piston is a shank, which is closely fitted within and protrudes downward through the aperture. The foot also includes a lower central air passage defined through the piston and shank, and an upper central air passage, defined at least partially within the upper end of the cylinder. The upper central passage communicates with the suction system.

Also included are main air passageways, defined at least partially within the side walls of the cylinder, which communicate between the upper central passage and the cavity at a point below the piston even when the shank is fully extended downward. Further included are reapportioning air passageways, defined at least partially within the side walls of the cylinder, which communicate between the upper central passage and the cavity at a point aligned with the piston when the shank is fully extended downward.

In a second of its independent aspects the invention is a suction foot system for separating and forwarding sheets of printing medium. The system is for use in a printing press that has a suction system that supplies a suction force. The system includes at least two suction feet distributed across the printing press, each communicating with the suction system and each receiving suction force from the suction system. Each suction foot is for extending toward and gripping the sheets.

Also included are means for partly reapportioning the suction force among several of the suction feet. For purposes of generality and breadth in expressing the invention these means will be called simply "the reapportioning means".

In certain preferred embodiments of this second aspect of the invention, the reapportioning means include means for reducing the suction force within the suction feet which are fully extended and increasing the suction force within all suction feet which are less than fully extended. The reduction in suction within the fully-extended suction feet is not detrimental to their operation. More importantly, the increase—or "boost"—in suction within the less-than-fully-extended suction feet tends to provide adequate extension suction to operate those feet properly.

In a third of its independent facets, the invention is a printing press for handling sheets of printing medium and for forming images on the sheets. The printing press includes means for processing an image on each sheet. Again, for purposes of generality these means will be called "the image-processing means".

Also included is a supply system for forwarding multiple sheets sequentially to the image-processing means. The supply system further includes at least two suction feet for extending toward and gripping the sheet and a suction system for supplying suction force to each of the suction feet.

The supply system also includes means for partly reapportioning the suction force among several of the suction feet—again, "the reapportioning means". Lastly included in the printing press are means for removing and collecting the sheets from the image-processing means.

All of the foregoing operational principles and advantages of the present invention will be more fully appreciated upon consideration of the following detailed description, with reference to the appended drawings, of which:

BRIEF DESCRIPTION OF THE DRAWINGS

(FIGS. 5 and 6 also both include section lines 4—4 along which FIG. 4 is taken.)

DETAILED DESCRIPTION OF THE PREFERRED EMBODIMENTS

The reapportioning suction foot and its inclusion in a suction foot system and a printing press, are improvements in the teachings of U.S. Pat. No. 4,580,773. The improvement aspects of the present invention are fully discussed herein. For a detailed description of common aspects and embodiment dimensions please refer to U.S. Pat. No. 4,580,773, the disclosure of which is hereby incorporated by reference.

Figure 1:
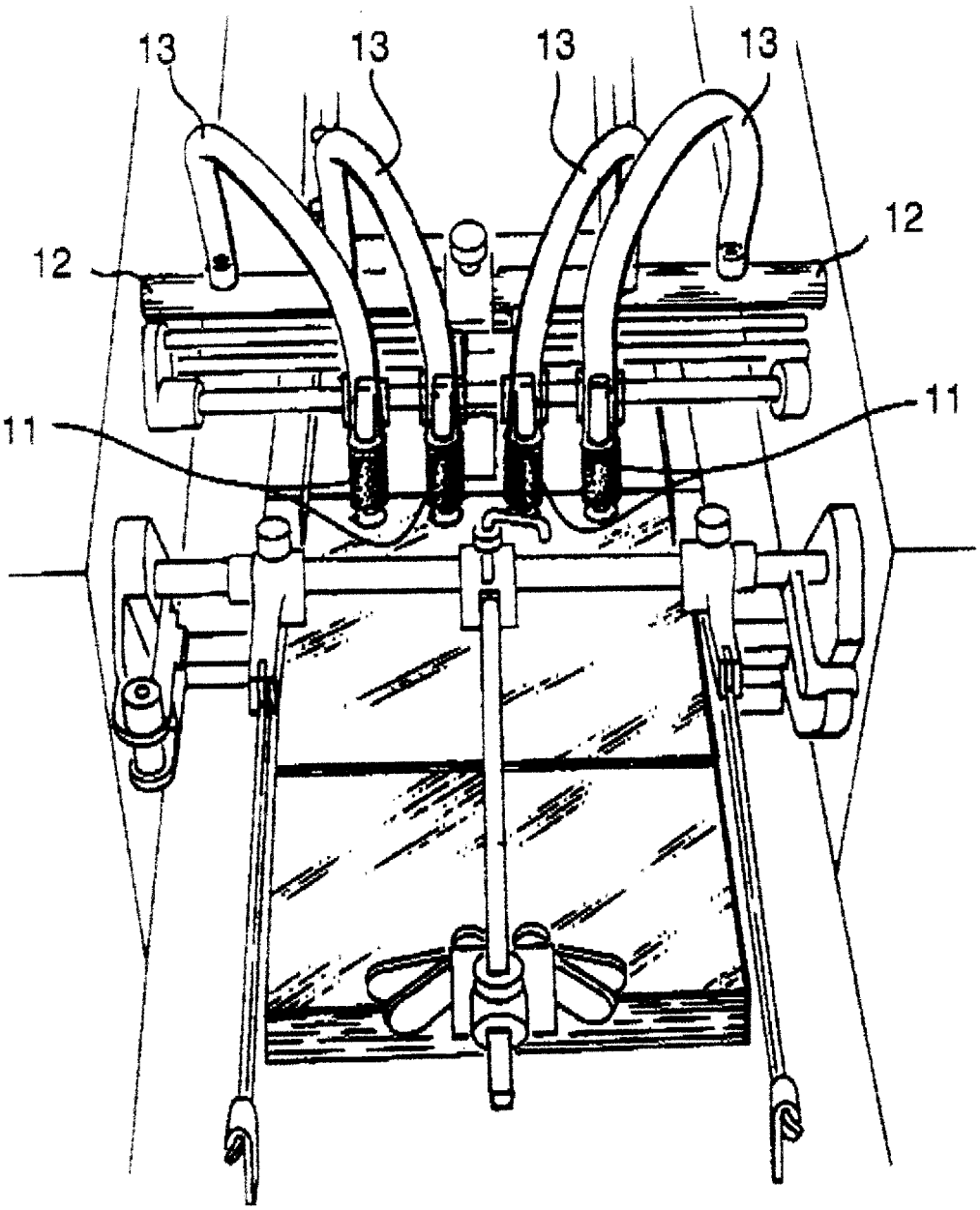
FIG. 1 is a very generalized perspective view of a printing press in accordance with the invention, also depicted are a suction foot system and several suction feet, each in accordance with the invention.

A preferred embodiment of my invention (FIG. 1) is a printing press having a series of reapportioning suction feet 11. The printing press also has a suction system that supplies suction to each foot 11. The typical suction system includes a suction pump (not shown), a tube 12, and a series of hoses 13—one for each foot 11.

Each foot 11 includes a cylinder 21 (FIG. 2) with external side walls 22, a closed upper end 23, and a lower end 24 with a constricted aperture 25. The interior of the cylinder 21 defines a cavity 26.

Figure 2:
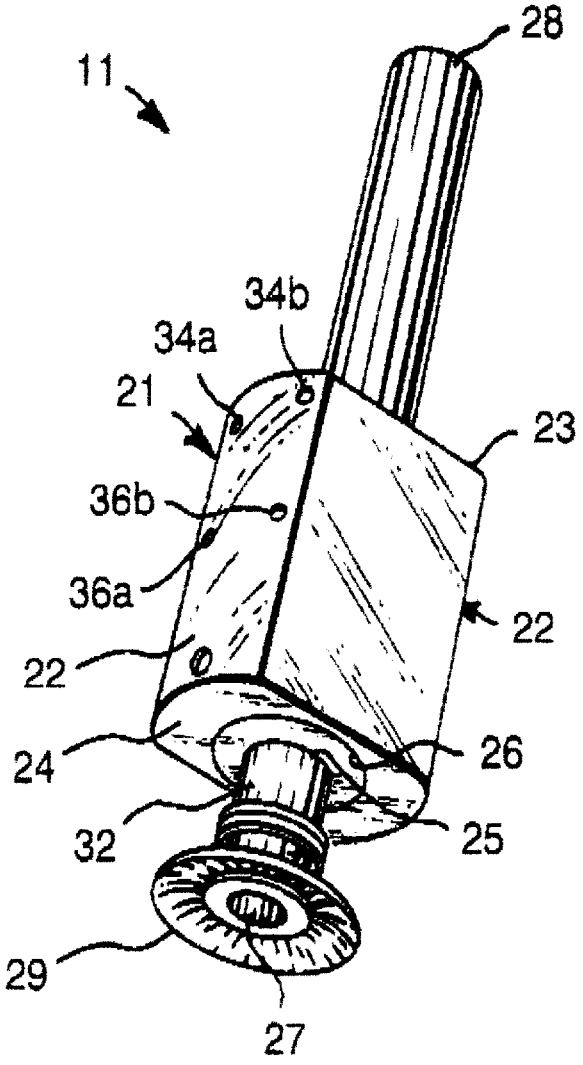
FIG. 2 is an exterior isometric or perspective view of a foot that is a preferred embodiment of the invention, taken from slightly below the foot.

Closely fitted within the cavity 26 is a piston 31 (FIG. 3) having a hollow shank 32 that extends downward through the constricted aperture 25 (FIG. 2). The hole of the hollow shank 32 (FIG. 3) extends upward through the piston 31. Also closely fitted within the cavity 26 and pushing upward on the piston 31 is a spring 37. Attached to the end of the shank 32 is a rubber boot 29.

Figure 3:
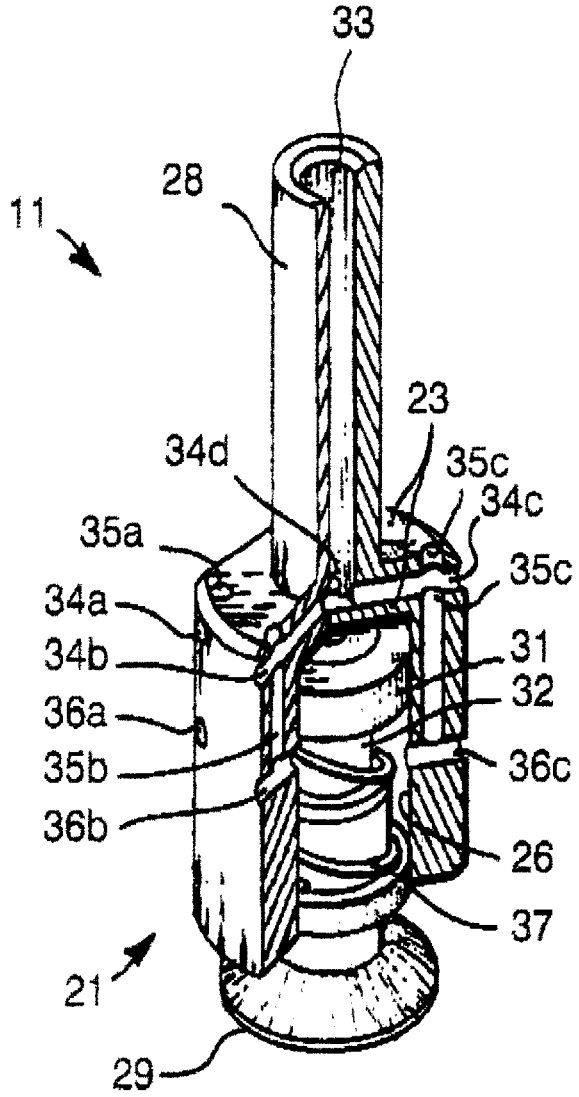
FIG. 3 is a like isometric or perspective view of the FIG. 2 embodiment, but taken from slightly above the foot, with the cylinder and support rod drawn partially in section to show the interior components and features.
Figure 4:
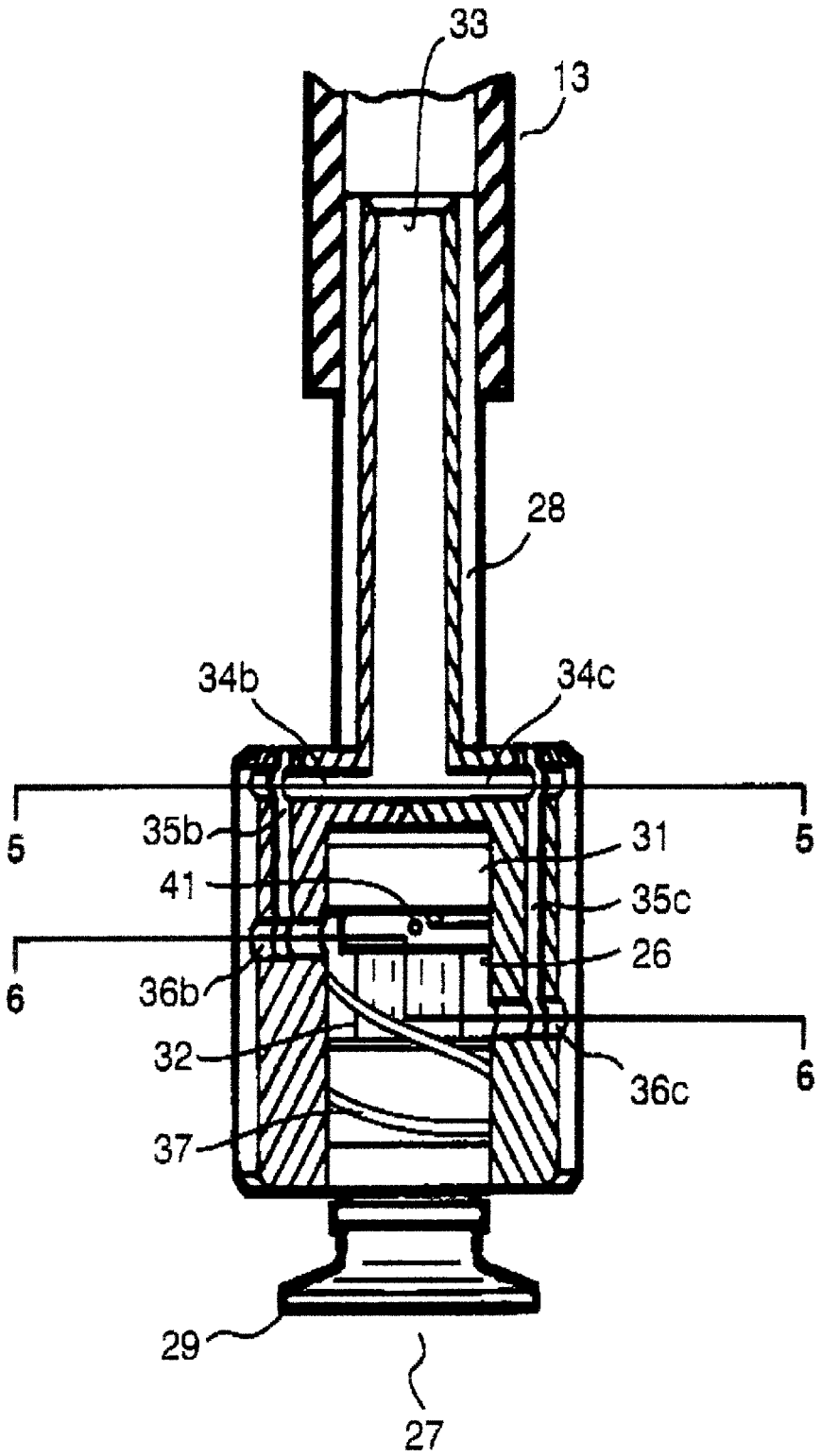
FIG. 4 is an elevation of the FIG. 2 embodiment with the cylinder and support rod in section to show the passages within the cylinder external side walls.

The hole through the piston 31 and the hollow shank 32 combine to define a lower central air passage 27 (FIGS. 2 and 4). Communicating between the lower central passage 27 and the portion of cavity 26 below the piston 31 are plural pilot holes 41 (FIG. 4) drilled through the shank 32. Extending from the top of the cylinder 21 (FIG. 3) is a support rod 28 which defines an upper central air passage 33. The upper central passage 33 extends downward into the upper end 23 of the cylinder 21.

Figure 5:
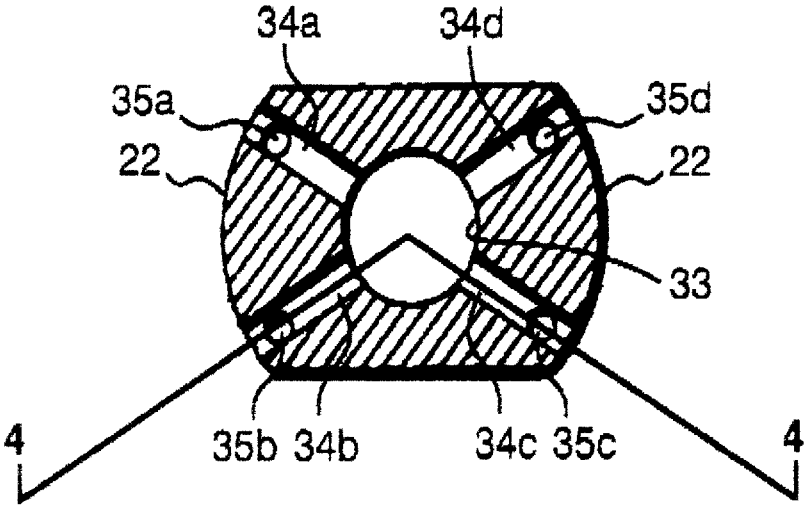
FIGS. 5 and 6 are sectional plans of the upper and central portions of the cylinder, taken respectively along line 5—5 and line 6—6 of FIG. 4.
Figure 6:
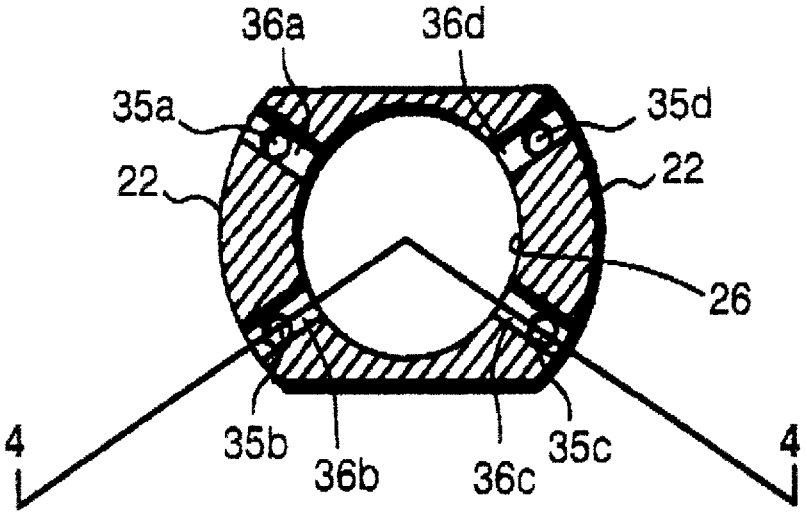

Drilled laterally through the upper end 23 and into the upper central passage 33 are two upper main radial passages 34c, 34*d* (FIGS. 3, 4, and 5). Intersecting these upper main radial passages 34*c*, 34*d* are main axial passages 35*c*, 35*d*; each drilled to a point below the piston 31 when the shank 32 is fully extended. Intersecting the main axial passages 35*c*, 35*d* can be found a pair of lower main radial passages 36*c*, 36*d*, (FIGS. 3, 4, and 6); each drilled through the side wall 22 at a point below the piston 31 even when the shank 32 is fully extended.

The outer ends of the radial passages 34*c*, 34*d*, 36*c*, 36*d* and the upper ends of the main axial passages 35*c*, 35*d* are plugged to form closed passageways between the upper central passage 33 and the cavity 26. I call these "main air passageways".

Also drilled laterally through the upper end 23 (FIG. 3, 4, and 5) and into the upper central passage 33 are two upper reapportioning radial passages 34*a*, 34*b*. Intersecting these upper reapportioning radial passages 34*a*, 34*b* are reapportioning axial passages 35*a*, 35*b*, which are drilled to a point aligned with the piston 31 when the shank 32 is fully extended. Intersecting the reapportioning axial passages 35*a*, 35*b* can be found a pair of lower reapportioning radial passages 36*a*, 36*b* (FIG. 3, 4, and 6); each drilled through the side wall 22 at a point aligned with the piston 31 when the shank 32 is fully extended.

The outer ends of the radial passages 34*a*, 34*b*, 36*a*, 36*b*, and the upper ends of reapportioning axial passages 35*a*, 35*b* are plugged to form closed passageways between the upper central passage 33 and the cavity 26. I call these "reapportioning air passageways".

The configuration of the reapportioning suction foot, with its main and reapportioning passageways, is distinct from my previous sheet-seeking suction foot. In the previous foot all passageways are main passageways—in other words, all intersect the cavity below the piston, even at full suction-foot extension.

For most-effective separation and forwarding of sheets of printing medium it is necessary that all feet 11 (FIG. 1) extend downward toward a sheet of medium, grip the sheet, and retract upward at approximately the same time. To provide this nearly synchronous operation it is crucial that sufficient extension suction be applied to each foot 11 to extend its shank 32 (FIG. 2).

Ideally, sufficient extension suction is supplied to all the feet 11 by the suction system. In practice, however, suction loss along the length of tube 12 (FIG. 1) can sometimes cause some feet 11 to receive less than adequate extension suction.

The following operational description of a series of feet 11 (FIG. 1) assumes all the feet 11 are substantially equal in mechanical and pneumatic characteristics. It also assumes the initial suction within the tube 12 at all points beyond the foot 11 nearest the pump, i.e. the first foot 11, is not adequate extension suction.

In operation, within each suction foot 11 the suction system creates a pressure differential between air in the upper central passage 33 (FIG. 3) and the air in the corresponding cavity 26 of each foot 11 in the series. This differential causes the air within each cavity 26 to flow into both the main and reapportioning passageways thereby creating extension suction within the cavity 26. In the first foot 11, but not the others, this suction is strong enough to draw the piston 31 downward against the action of the spring 37, causing the shank 32 to move downward from its retracted position (FIGS. 3 and 4).

As the shank 32 extends downward the piston 31 aligns with the lower reapportioning radial passages 36*a*, 36*b* (FIGS. 3, 4 and 6), thereby blocking the reapportioning passageways. This blockage limits the airflow within the first foot 11 to the main passageways and thus reduces the extension suction of the first foot 11. Because the shank 32 is already extended the reduction in the first foot 11 extension suction does not deter its continued operation. In fact, maintaining extension suction at this point in operation is not only unnecessary—it is wasteful.

The series of feet 11 in combination with the suction system form a pneumatic system. This system reacts to the above-described airflow reduction in the first foot 11 by increasing the airflow through the reapportioning and main passageways of all remaining feet 11 in the series. The increased airflow results in an extension suction boost within all feet 11 beyond the first foot 11.

Thus my present invention compensates for suction system losses by reapportioning part of the extension suction from the first foot 11 to all the remaining feet 11. This reapportioning effect is not provided by my prior suction foot where, as previously mentioned, all passageways are main passageways and there is a continuous and wasteful application of extension suction within the fully-extended feet—and sometimes possibly inadequate suction to the less-than-fully-extended feet 11.

Suppose now, due to this boosting reapportionment, the second foot 11 has adequate extension suction to draw its piston 31 downward. As the shank 32 of the second foot 11 extends downward, the above-described suction boost occurs again within the feet 11 beyond the second foot 11. The process continues until each foot 11 in turn has adequate extension suction.

To continue effective operation it is next necessary that each extended foot 11 grip the sheet of print medium beneath it. For this to occur each foot 11 must have sufficient gripping suction to affirmatively hold the sheet against the bottom tip of the shank 32 while the sheet is lifted.

Gripping suction is created by the pressure differential between the pressure in the upper central passage 33 and the air pressure beneath the shank 32. This differential causes air to flow from beneath the shank 32 through the lower central air passage 27. The airflow continues through the pilot holes 41 (FIG. 4), into the cavity 26 and finally into the main passageways.

Soon after the shank 32 is fully extended the boot 29 comes in contact with the sheet. The gripping suction is applied to the upper surface of the sheet, thereby holding the sheet against the shank 32. Once the sheet closes the lower central passage 27 the pressure differential within the cavity 26, above and below the piston 31 is neutralized. The spring 37 raises the piston 31—and with it the shank 32 and the sheet.

If, contrary to the preceding assumption, the mechanical and pneumatic characteristics of the feet 11 are not equal—due to spring 37 tolerance variations or friction between the cavity 26 and piston 31—the operation of the feet 11 is still as previously described. In this situation, however, the order in which feet 11 obtain adequate extension suction may be nonconsecutive with respect to their positions along the suction tube 12.

The above disclosure is intended as merely exemplary, and not to limit the scope of the invention—which is to be determined by reference to the appended claims.

What is claimed is:

1. A suction foot for separating and forwarding sheets of printing medium, for use in a printing press that has a plurality of said suction feet and a suction system; said suction foot comprising:

a cylinder having external side walls and a closed upper end to define a cavity and a lower end with a constricted aperture;

a piston closely fitted within the cavity and having a downward extending shank that is closely fitted within and protrudes downward through the aperture;

a lower central air passage defined through the piston and shank;

an upper central air passage, defined at least partially within the upper end of the cylinder, communicating with such suction system;

main air passageways, defined at least partially within the side walls of the cylinder, communicating between the upper central air passage and the cavity at a point below the piston when the shank is fully extended downward; and reapportioning air passageways, defined at least partially within the side walls of the cylinder, communicating between the upper central air passage and the cavity at a point aligned with the piston when the shank is fully extended downward.

2. A suction foot system for separating and forwarding sheets of printing medium, for use in a printing press that has a suction system supplying a suction force; said suction foot system comprising:

at least two suction feet distributed across such printing press, each communicating with such suction system and each receiving a suction force from such suction system, each said suction foot for extending toward and gripping such sheet; and means for partly reapportioning such suction force among several of the suction feet.

3. The suction foot system of claim 2, wherein the reapportioning means comprise:

means for reducing such suction force within the suction feet which are fully extended and increasing such suction force within all suction feet which are less than fully extended.

4. A printing press for handling sheets of printing medium and for forming images thereon; said printing press comprising:

means for processing an image on each such sheet;

a supply system for forwarding multiple such sheets sequentially to the image-processing means, said supply system including:

at least two suction feet for extending toward and gripping such sheet, a suction system for supplying suction force to each of the suction feet, means for partly reapportioning the suction force among several of the suction feet; and means for removing and collecting such sheets from the image-processing means.

5. The printing press of claim 4, wherein the reapportioning means comprise:

means for reducing the suction force within the suction feet which are fully extended and increasing the suction force within all suction feet which are less than fully extended.

* * * * *